US007909185B1

(12) United States Patent
Erby-Jones

(10) Patent No.: US 7,909,185 B1
(45) Date of Patent: Mar. 22, 2011

(54) WRAP AND ROLL LIGHT CORD HOLDER

(76) Inventor: Antoinette Erby-Jones, Washington, DC (US)

( * ) Notice: Subject to any disclaimer, the term of this patent is extended or adjusted under 35 U.S.C. 154(b) by 1232 days.

(21) Appl. No.: 11/269,850

(22) Filed: Nov. 9, 2005

Related U.S. Application Data

(60) Provisional application No. 60/629,315, filed on Nov. 19, 2004.

(51) Int. Cl.
*A47H 1/00* (2006.01)

(52) U.S. Cl. ..... 211/123

(58) Field of Classification Search ..... 211/123, 211/196, 205, 70, 53, 78, 163, 60.1, 77; 248/121; 47/47; D6/411, 458, 468, 465, 462; D11/146; 242/402
See application file for complete search history.

(56) References Cited

U.S. PATENT DOCUMENTS

| | | | | | |
|---|---|---|---|---|---|
| 380,127 | A | * | 3/1888 | McGaffey | 242/403.1 |
| 457,469 | A | * | 8/1891 | Woodward | 242/391 |
| 1,089,290 | A | * | 3/1914 | Thompson | 248/165 |
| 1,137,900 | A | * | 5/1915 | Reichert | 211/163 |
| 1,471,909 | A | * | 10/1923 | Miller | 211/187 |
| 2,872,032 | A | * | 2/1959 | West | 206/419 |
| 2,984,347 | A | * | 5/1961 | Kalinchuk | 206/419 |
| 3,204,779 | A | * | 9/1965 | Warner | 211/190 |
| 3,384,227 | A | * | 5/1968 | Spatz | 206/420 |
| 4,261,529 | A | | 4/1981 | Sandberg et al. | |
| 4,586,675 | A | | 5/1986 | Brown | |
| 4,819,817 | A | * | 4/1989 | Mar | 211/205 |
| 4,917,323 | A | | 4/1990 | Wing | |
| 4,971,200 | A | | 11/1990 | Huang et al. | |
| 5,033,619 | A | * | 7/1991 | Garis | 206/419 |
| 5,064,067 | A | * | 11/1991 | McAllister et al. | 206/420 |
| 5,127,528 | A | * | 7/1992 | Cone | 211/34 |
| 5,168,999 | A | | 12/1992 | Lee et al. | |
| D334,855 | S | * | 4/1993 | Harrington et al. | D6/458 |
| 5,381,899 | A | * | 1/1995 | Rabbitt | 206/397 |
| D375,251 | S | * | 11/1996 | Stevens et al. | D8/359 |
| 5,598,985 | A | * | 2/1997 | Winesett | 242/395 |
| 5,653,339 | A | * | 8/1997 | Dobson | 206/420 |
| 5,661,953 | A | * | 9/1997 | Jolley | 53/430 |
| 5,695,148 | A | * | 12/1997 | Christensen | 242/405.3 |
| 5,868,334 | A | * | 2/1999 | Cedillo | 242/405.3 |
| 5,924,570 | A | * | 7/1999 | Sickles | 206/419 |
| 5,957,401 | A | * | 9/1999 | O'Donnell | 242/404.3 |
| 6,056,226 | A | * | 5/2000 | Green | 242/395 |
| 6,241,176 | B1 | * | 6/2001 | McEntee | 242/405.3 |
| 6,386,491 | B1 | * | 5/2002 | Bissett | 248/121 |
| 6,398,148 | B1 | * | 6/2002 | Snow | 242/395.1 |
| 6,467,623 | B1 | * | 10/2002 | Lewis et al. | 206/575 |
| 6,497,381 | B2 | * | 12/2002 | Rose | 242/402 |
| 6,557,792 | B1 | * | 5/2003 | Snow | 242/395.1 |

(Continued)

*Primary Examiner* — Sarah Purol
(74) *Attorney, Agent, or Firm* — Venable LLP; Jeffri A. Kaminski; Justine A. Gozzi

(57) ABSTRACT

A lightweight storage device for objects strung on a cord or cords includes an elongated rod having two ends and being made of lightweight material, a foot on each end of the elongated rod; and a plurality of separating elements spaced along the elongated rod where each plurality of separating elements includes a number of pegs circumferentially disposed about a plane intersecting with the elongated rod and wherein the length of each peg in each separating element is approximately the same and is of a length so that at least two of the pegs are capable of holding the elongated rod stationary and the length of each peg is such that a string of objects wrapped about the elongated rod are spaced from the ground when the lightweight storage device is placed on the ground.

14 Claims, 3 Drawing Sheets

U.S. PATENT DOCUMENTS 6,676,069 B1 * 1/2004 Davis ..... 242/609.1
6,783,093 B2 * 8/2004 Limber ..... 242/405.2
D496,191 S * 9/2004 Johnson ..... D6/465
6,918,557 B2 * 7/2005 Ast et al. ..... 242/388.6
6,925,754 B1 * 8/2005 Tearoe ..... 47/47
6,948,680 B2 * 9/2005 Ganster ..... 242/601
7,017,743 B1 * 3/2006 Patterson ..... 206/419
7,293,734 B1 * 11/2007 Kantner et al. ..... 242/395.1
7,306,101 B2 * 12/2007 Murry ..... 206/408
7,318,561 B1 * 1/2008 Giampietro ..... 242/402
7,350,741 B1 * 4/2008 Rosa ..... 242/557
7,484,684 B2 * 2/2009 Saavedra et al. ..... 242/391

* cited by examiner

WRAP AND ROLL LIGHT CORD HOLDER

CROSS REFERENCE TO RELATED APPLICATION

This application is a non-provisional of pending U.S. application No. 60/629,315 filed Nov. 19, 2004, the subject matter of which is incorporated herein by reference.

FIELD OF THE INVENTION

The present invention relates to an apparatus for storing lights or other objects strung on a cord or cords, such as holiday lights, where lights or objects strung on a cord can be easily wrapped around the apparatus for storage, and then, easily unwound to use the lights or objects. More particularly, the present invention is directed to a lightweight storage device that allows a user to wrap a string of lights about a rod, which offers protection to the saved string(s) of lights.

BACKGROUND OF THE INVENTION

Decorative light packages typically comprise plastic frames such as those disclosed, for example, in U.S. Pat. Nos. 4,971,200 and 5,168,999, that support the decorative bulb and socket assemblies of decorative light strings in aligned rows, with the connecting wires folded therebetween. Such frames are inserted into cardboard boxes or sleeves at the factory. It is often a difficult and time-consuming task to reinsert the decorative light strings back into the original packaging modules for storage following use. Because of this, such light strings are frequently coiled up and placed into boxes or bags, where they can become tangled, causing difficulty when they are subsequently reused.

Various devices have previously been disclosed for use in storing decorative light strings that are easier to work with than the original packaging and are intended to reduce the likelihood of tangling. Such devices are disclosed, for example, in U.S. Pat. Nos. 4,261,529; 4,586,675; 4,917,323 and 5,064,067. Reels or apparatuses with arms around which cords or lights strung on cords can be wound are known in the art. However, these storage structures cannot separate sections of lights strung on a cord and provide a storage device that protects the lights from breakage.

Moreover, these known storage devices may be cumbersome and heavy so that a user may have difficulty in gathering the lights and encounter more difficulty when trying to restring the lights in a decorative fashion.

Therefore, there exists a continuing need for new and improved lights strung on a cord holder, which can be used to easily gather the lights strung on a cord onto the holder, store the lights without lights breaking, and easily remove the lights from the holder.

SUMMARY OF THE INVENTION

It is therefore an object of the present invention to create an apparatus for storing lights or objects strung on a cord or cords, such as holiday lights, where lights or objects strung on a cord can be easily wrapped around the apparatus for storage, and then, easily unwound to use the lights or objects.

This may be achieved by a lightweight storage device for objects strung on a cord or cords that includes an elongated rod having two ends and being made of lightweight material, a foot on each end of the elongated rod, and a plurality of separating elements spaced along the elongated rod where each plurality of separating elements includes a number of pegs circumferentially disposed about a plane intersecting with the elongated rod and wherein the length of each peg in each separating element is approximately the same and is of a length so that at least two of the pegs are capable of holding the elongated rod stationary and the length of each peg is such that a string of objects wrapped about the elongated rod are spaced from the ground when the lightweight storage device is placed on the ground.

According to an exemplary embodiment of the invention, the feet may have slots or grooves that function to hold secure plugs of lights, extension cords, phone cords and the like.

The foot of the elongated rod may be attached via a threaded fastener or dowel. The threaded fastener or dowel is inserted into a hole or recess at the end of the elongated rod and the hole or recess may be used to receive extension pieces to the lightweight storage device.

The elongated rod of one embodiment of the invention has at least two separating elements and the area between the separating elements is capable of receiving a cord having approximately 100 objects or lights.

According to another embodiment of the invention, an extension piece may be added to the elongated rod to hold even more objects or lights. The extension piece is an elongated rod with at least one separating element. One end of the extension has a foot with a slot for receiving a plug, while the other end has a fastener, such as a headless screw extending from a hole or recess centrally located within the end of the elongated rod.

A method of storing objects strung on a cord according to one embodiment of the invention includes placing an end of a cord of objects on a foot of a lightweight storage device, rotating the lightweight storage device thereby causing the cord of objects to be wrapped along an area of the elongated rod of the lightweight storage device between first adjacent separating elements of the lightweight storage device, when the area between the first adjacent separating elements is full, continue rotating the elongated rod so that the next wrap of the cord of objects is in the area between the second adjacent separating elements of the lightweight storage device, and when finished wrapping the cord of objects, the lightweight storage device may be stored away.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Figure 1:
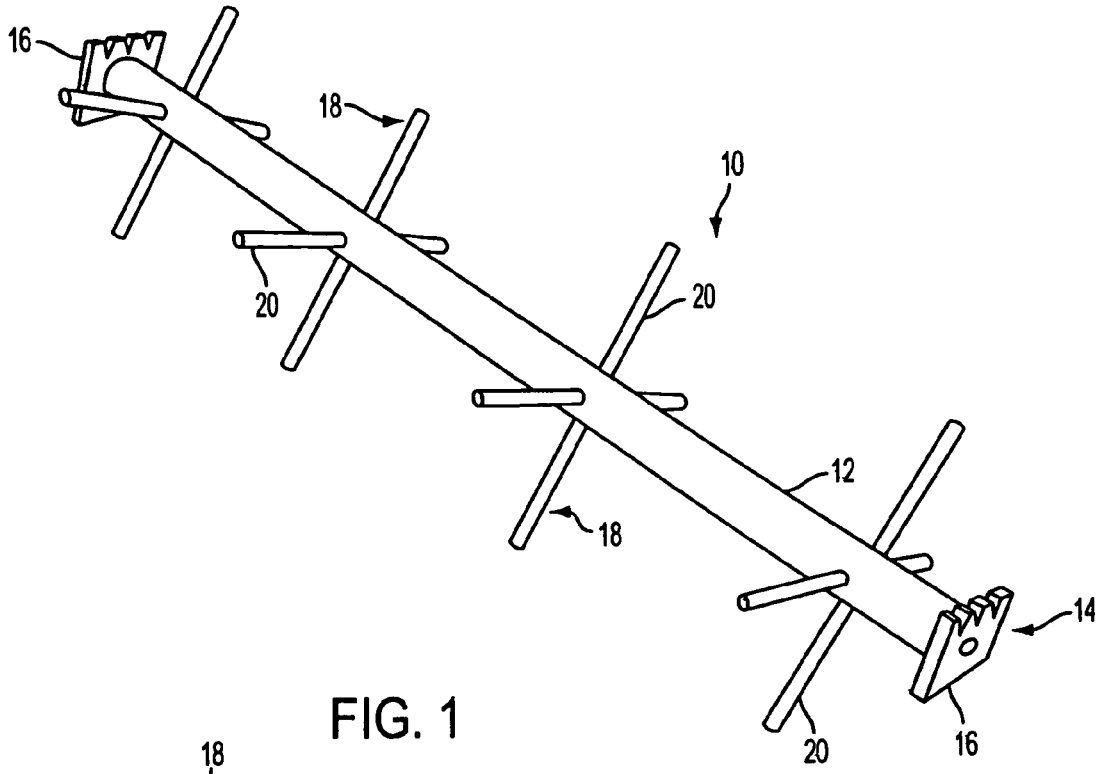
FIG. 1 schematically depicts a wrap and roll cord saver according to an embodiment of the invention.
Figure 2:
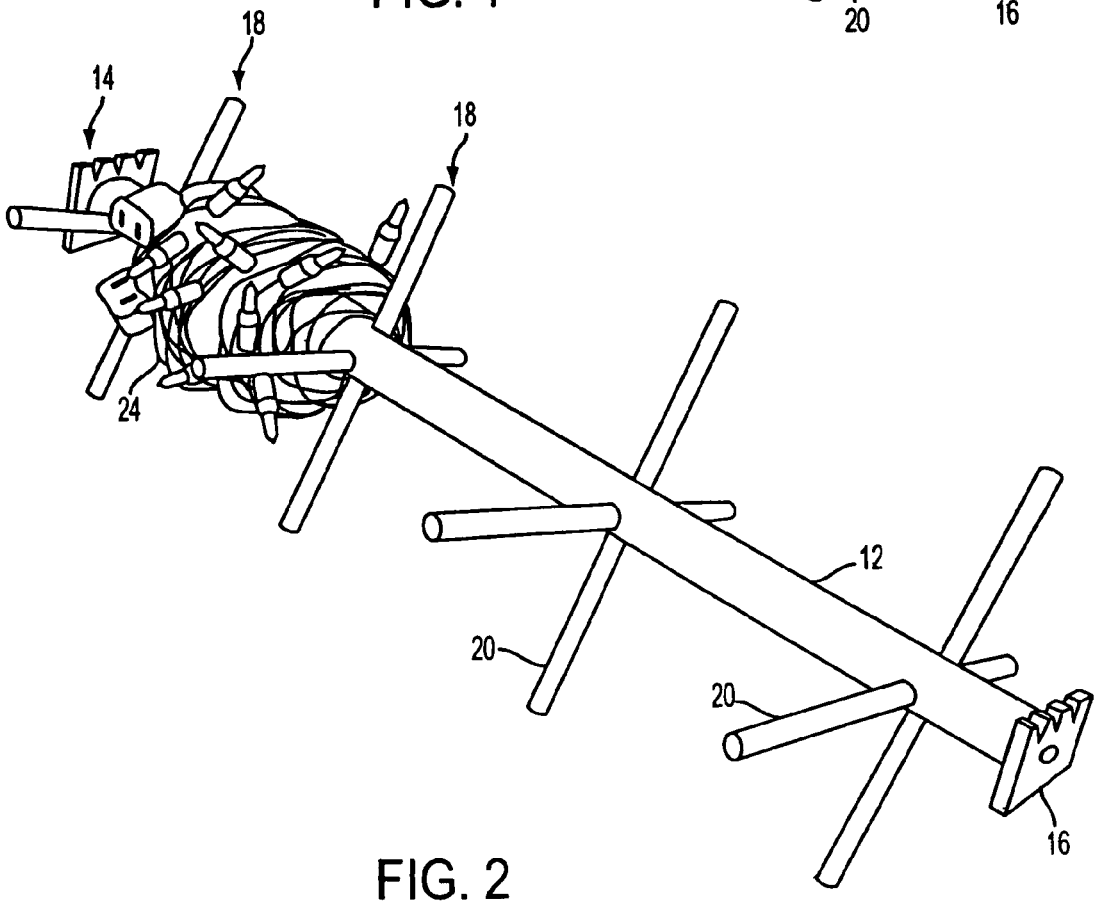
FIG. 2 illustrates a string of holiday lights wrapped around the embodiment shown in FIG. 1.

Looking at FIGS. 1 and 2 of the drawings, a lightweight storage device 10 for objects strung on a cord or cords is shown. Lightweight storage device 10 includes an elongated rod 12 having two ends 14. The elongated rod 12 may be made of lightweight material, such as wood or plastic and preferably has a centrally located hole or recess at each end 14. A foot 16 is disposed on each end 14 of the elongated rod and may be secured to an end 14 of the elongated rod 12 by a dowel or threaded fastener either friction-fitted or screwed within the centrally located hole. Elongated rod 12 may be from approximately 15 inches to 22 inches long and has a diameter of up to approximately 3 inches.

Elongated rod 12 has a plurality of separating elements 18 spaced along its longitudinal axis. Each plurality of separating elements 18 includes a number of pegs 20 circumferentially disposed about a plane intersecting with elongated rod 12. The length of each peg 20 in each separating element 18 is approximately the same and is of a length so that at least two of the pegs 18 are capable of holding the elongated rod 12 stationary. In addition, the length of each peg 20 is such that a string of objects 24 wrapped about the elongated rod are spaced from the ground when the lightweight storage device is placed on the ground. There may be three to four separating elements disposed along elongated rod 12.

For example, in one embodiment, there may be 16 holes drilled in an elongated rod 12 for four spacing elements 18 disposed along the elongated rod 12. The four holes for each spacing element 18 are evenly spaced from around the circumference of elongated rod 12. The four holes are for holding pegs 20 of each spacing element 18, and may be about a half an inch to 1 inch apart depending upon the diameter of elongated rod 12.

Pegs 20 may extend about 2-3 inches from the periphery of elongated rod 12 and are about a quarter inch in diameter. Pegs 20 may be friction fitted within the holes drilled into elongated rod 12, or the pegs may be attached in other equivalent ways known to those skilled in the art. Each spacing element 18 may have four pegs and each spacing element 18 may be disposed about 6 inches from another spacing element 18. The area between adjacent spacing elements provides sufficient space for wrapping a cord or cords with approximately 100 objects. Pegs 20 perform a standing effect, which prohibits the objects wrapped on the lightweight storage device 10 from touching the floor or table or ground.

Feet 16 may be provided with slots to secure cord ends, such as an electrical plug of a cord to be wrapped around the elongated rod, so that the cord will not unravel unless a user wants to unwrapped the saved objects on a cord. Feet 16 may be secured with a threaded fastener so that the feet can be removed, if desired, to add an extension piece.

Figure 4:
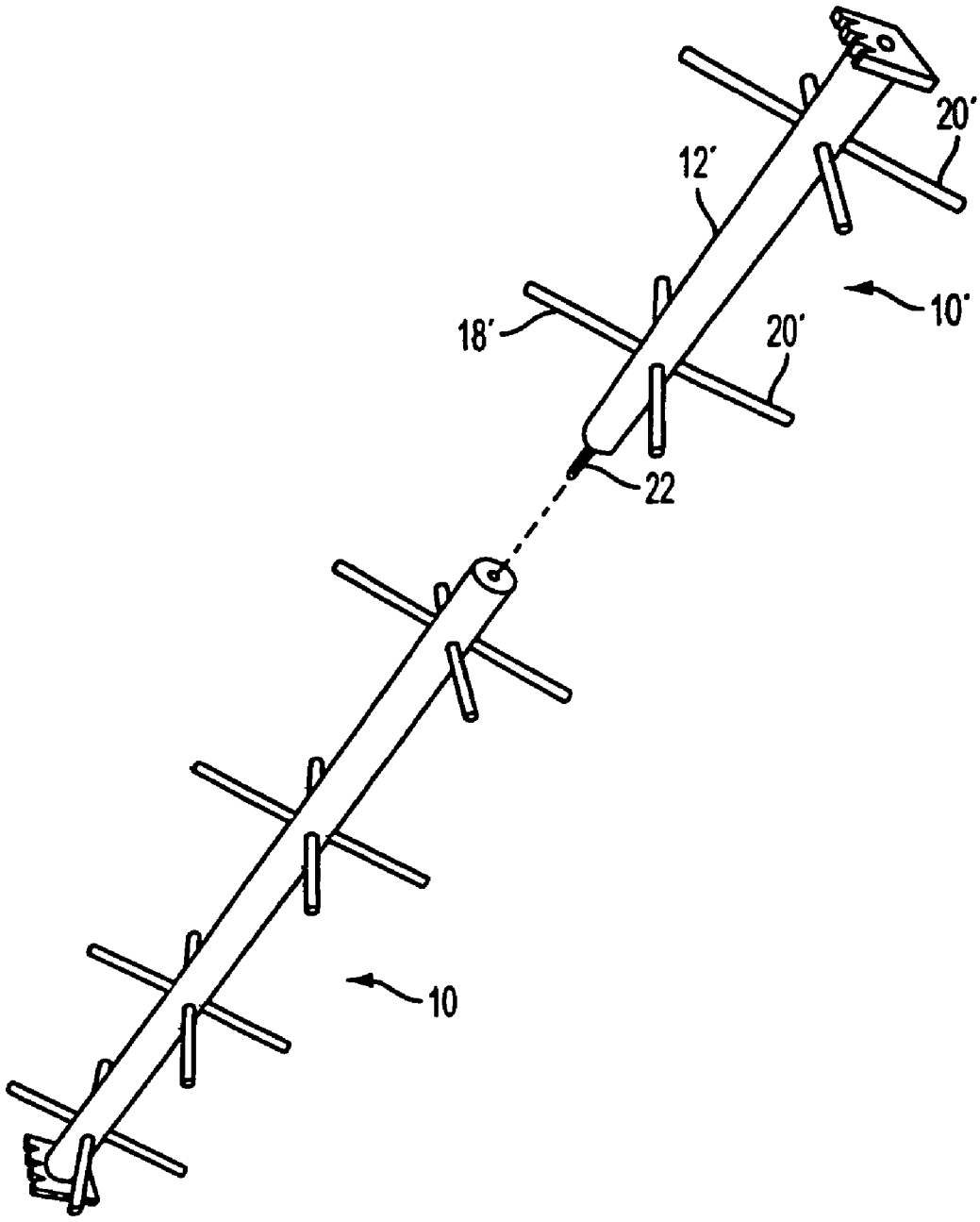
FIG. 4 depicts a wrap and roll cord saver and an extension piece according to another embodiment of the invention.

A lightweight extension piece 10' may be used to add additional protected storage areas to a lightweight storage device 10 (see FIG. 4). The lightweight extension piece has an elongated extension rod 12' with centrally located holes on either side of the extension rod, a foot on one end of the elongated extension rod 12', and a fastener 22 extending from the hole on the other end of the elongated extension rod 12' where the fastener 22 is adapted to be inserted into a centrally located hole on an end of the lightweight storage device 10.

The lightweight extension piece may include at least one separating element 18' spaced along the elongated extension rod 12' where the at least one separating element 18' includes a number of pegs 20' circumferentially disposed about a plane intersecting with the elongated extension rod 12' and wherein the length of each peg 20' in each separating element 18' is approximately the same and is of a length so that at least two of the pegs 20' are capable of holding the elongated extension rod 12' stationary and the length of each peg 20' is such that a string of objects 24 wrapped about the elongated extension rod 12' are spaced from the ground when the lightweight storage device 10, to which the extension piece is attached, is placed on the ground.

Pegs 20 may separate different kinds of wires or cords. The pegs of each separating element also enable the lightweight storage device to stand up so that none of the objects strung on the wrapped cord(s) touch the ground, floor or table. Moreover, even if the lightweight storage device is inadvertently rolled on the floor, table or ground, the objects strung on the wrapped cord(s) may be protected from the floor, table or ground. Generally, pegs 20 do not roll and cause the lightweight storage device 10 to remain stationary unless acted upon by an outside force.

Figure 3:
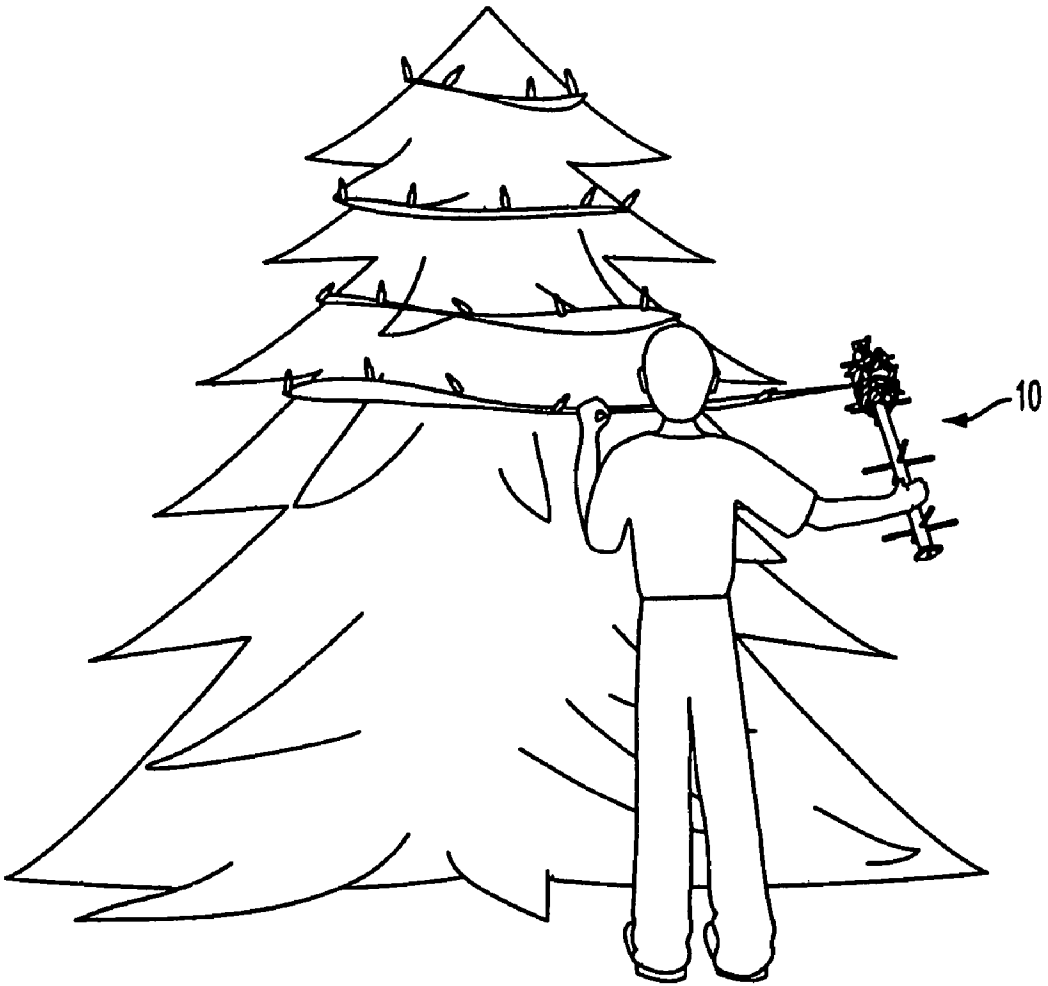
FIG. 3 schematically depicts a child using the wrap and roll saver to decorate a holiday tree.

As shown in FIG. 3, the lightweight storage device according to the invention is easy to use: both for storing objects on a cord and unwrapping stored objects on a cord. The method of storing objects strung on a cord includes placing an end of a cord of objects on a foot of a lightweight storage device of the present invention, rotating the lightweight storage device thereby causing the cord of objects to be wrapped along an area of the elongated rod of the lightweight storage device between the first adjacent separating elements of the lightweight storage device, when the area between the first adjacent separating elements is full, continue rotating the elongated rod so that the next wrap of the cord of objects is in the are between the second adjacent separating elements of the lightweight storage device, and when finished wrapping the cord of objects, the lightweight storage device may be stored away. This method is simple and easy to do as a result of the wrap and roll action. Consequently, a small adult or even a child could easily store away lights, for example, that were decorating a holiday tree.

Similarly, the method of unwrapping objects strung on a cord employs the same wrap and roll action. This method includes taking a lightweight storage device with objects on a cord wrapped around an elongated rod of the storage device, and rotating the lightweight storage device in the opposite direction with which the objects were wrapped around the elongated rod thereby unwinding the cord of objects so they can be placed in a decorative manner on another object to be decorated.

If additional lights or objects strung on a cord need to be saved, an extension piece can easily and quickly be added to a lightweight storage device. The extension piece may either be screwed into a centrally located hole on the elongated rod of the lightweight storage device, or, it may be friction fit into the hole of the elongated rod. This may be done easily with a snap and a twist or by screwing the extension piece to the elongated rod.

Applicant envisions that a bag with a hand or shoulder tote may be used with the wrap and roll cord saver to keep dust off objects strung on wrapped cord(s). The bag may be of nylon material or other easily foldable material. The length of the bag should be long enough to receive a lightweight storage device 10 of a wrap and roll cord saver and a lightweight extension piece 10'. The bag may have a zipper for easy access to the stored lightweight storage device 10.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

I claim:

1. A lightweight storage device for a cord of objects comprising:

an elongated rod having two ends, the elongated rod having a longitudinal axis extending from one end to the other end, the elongated rod being made of lightweight material and the elongated rod capable of housing the cord of objects around the elongated rod;

a foot coupled to each end of the elongated rod, each foot having at least one slot for receiving an end of the cord to be wrapped around the elongated rod; and a plurality of elements to support the elongated rod statically on a surface and to segregate the cord of objects wrapped around the elongated rod into sections, wherein each element is coupled to the elongated rod and located at a longitudinal distance from an adjacent element, each element comprising:

a plurality of pegs extending approximately perpendicular from the elongated rod and circumferentially disposed about the axis so that each peg of one element is located within a same plane perpendicular to the elongated rod, wherein each peg is about equal in length and has a length greater than a length of each foot to allow the pegs to rest statically on the surface to support the elongated rod and to prevent the device from moving wherein the elongated rod is from approximately 15 inches to 22 inches long and has a diameter of up to approximately 3 inches, and wherein there are three to four elements disposed along the elongated rod.

2. The lightweight storage device according to claim 1, wherein each foot is secured to the elongated rod by a threaded fastener or a dowel.

3. The lightweight storage device according to claim 1, wherein an area between two adjacent elements defines a storage area for a cord of objects and each element has at least four pegs that enable the lightweight storage device to stand stationary when the device is placed on its side on the surface.

4. The lightweight storage device according to claim 1, wherein the elements are located about 5-6 inches apart from one another along the elongated rod.

5. The lightweight storage device according to claim 1, wherein the pegs of each element extend about 2-3 inches from a periphery of the elongated rod and are about a quarter inch in diameter.

6. The lightweight storage device according to claim 1, wherein the elongated rod has at least two elements and an area between the elements is capable of receiving the cord having approximately 100 lights.

7. The lightweight storage device according to claim 1, wherein the elongated rod is approximately an inch in diameter and the pegs are approximately 2.5 inches to approximately 3 inches in length.

8. The lightweight storage device according to claim 1, further comprising an extension piece for adding additional protected storage areas to a lightweight storage device, said lightweight extension piece comprising:

an elongated extension rod having the same single axis as the extension rod and having two end faces, the elongated extension rod defining centrally located holes on either end face of the extension rod;

a foot fastened to the one end face of the elongated extension rod;

a fastener attached to the other end face of the elongated extension rod, wherein the fastener is adapted to be inserted into a centrally located hole on an end of the lightweight storage device; and at least one element to support the elongated extension rod on the surface and to segregate the cord of objects wrapped around both the elongated rod and the elongated extension rod into sections, wherein each element is coupled to the elongated extension rod and located at a longitudinal distance from an adjacent element.

9. The lightweight storage device according to claim 8, wherein each element of the extension piece has at least four pegs that enable the lightweight extension piece to stand stationary when connected with the lightweight storage device and the lightweight storage device is placed on the surface on its side so that two pegs of each element rest on the ground.

10. The lightweight storage device according to claim 8, wherein the elongated extension rod has at least two elements and the area between the elements is capable of receiving a cord having approximately 100 lights.

11. The lightweight storage device according to claim 8, wherein the fastener is a headless screw.

12. The lightweight storage device according to claim 8, wherein an area between two adjacent elements defines a storage area for a cord of objects and the at least one element has at least four pegs that enable the lightweight extension piece to stand stationary when connected to the lightweight storage device.

13. A method of storing a cord of objects having a first end and a second end on a lightweight storage device, the lightweight storage device including an elongated rod having two ends, the elongated rod having a single longitudinal axis extending from one end to the other end wherein the elongated rod is from approximately 15 inches to 22 inches long and has a diameter of up to approximately 3 inches, and wherein there are three to four elements disposed along the elongated rod, the elongated rod being made of lightweight material and the elongated rod capable of housing the cord of objects around the elongated rod; feet coupled to each end of the elongated rod, each foot having at least one slot for receiving one of the first or second ends of the cord of objects to be wrapped around the elongated rod; and a plurality of elements to support the elongated rod statically on a surface and to segregate the cord of objects wrapped around the elongated rod into sections, wherein each element is coupled to the elongated rod and located at a longitudinal distance from an adjacent element, each element comprising: a plurality of pegs extending approximately perpendicular from the elongated rod and circumferentially disposed about the single axis so that each peg of one element is located within a same plane perpendicular to the elongated rod, wherein each peg is about equal in length and has a length greater than a length of each foot to allow the pegs to rest on the surface to support the elongated rod and to prevent the device from moving, the method, comprising:

placing the first end of the cord of objects within the slot of the foot of the lightweight storage device;

rotating the elongated rod of the lightweight storage device thereby causing the cord of objects to be wrapped along an area of the elongated rod of the lightweight storage device between adjacent elements of the lightweight storage device;

when an area between adjacent elements is full, further rotating the elongated rod so that a next wrap of the cord of objects is in an area between next adjacent elements of the lightweight storage device;

when finished wrapping the cord of objects, placing a second end of the cord within the slot of the foot to secure the cord to the lightweight storage device; and storing the lightweight storage device.

14. A method of unwrapping a cord of objects having a first end and a second end previously strung on a light weight storage device, the light weight storage device including an elongated rod having two ends wherein the elongated rod is from approximately 15 inches to 22 inches long and has a diameter of up to approximately 3 inches, and wherein there are three to four elements disposed along the elongated rod, the elongated rod having a single longitudinal axis extending from one end to the other end, the elongated rod being made of lightweight material and the elongated rod capable of housing the cord of objects around the elongated rod; feet coupled to each end of the elongated rod, each foot having at least one slot for receiving one of the first or second ends of the cord of objects to be wrapped around the elongated rod; and a plurality of elements to support the elongated rod statically on a surface and to segregate the cord of objects wrapped around the elongated rod into sections, wherein each element is coupled to the elongated rod and located at a longitudinal distance from an adjacent element, each element comprising: a plurality of pegs extending approximately perpendicular from the elongated rod and circumferentially disposed about the single axis so that each peg of one element is located within a same plane perpendicular to the elongated rod, wherein each peg is about equal in length and has a length greater than a length of each foot to allow the pegs to rest on the surface to support the elongated rod and to prevent the device from moving, the method, comprising:

removing the end of the cord from the slot of the foot of the lightweight storage device thereby releasing the cord from a storage position;

placing the cord of objects on another object to be decorated; and rotating the elongated rod of the lightweight storage device in the opposite direction with which the objects were wrapped around the elongated rod thereby unwinding the cord of objects so they can be placed in a decorative manner on the other object to be decorated.

* * * * *